US006501381B1

(12) United States Patent
Pilested

(10) Patent No.: US 6,501,381 B1
(45) Date of Patent: Dec. 31, 2002

(54) SECURITY SYSTEM FOR MONITORING THE PASSAGE OF ITEMS THROUGH DEFINED ZONES

(75) Inventor: Karsten Gyde Pilested, Aurora (CA)

(73) Assignee: 1336700 Ontario Inc., Aurora (CA)

( * ) Notice: Subject to any disclaimer, the term of this patent is extended or adjusted under 35 U.S.C. 154(b) by 0 days.

(21) Appl. No.: 09/457,384

(22) Filed: Dec. 9, 1999

(30) Foreign Application Priority Data

Dec. 9, 1998 (CA) ..... 2255342

(51) Int. Cl.[7] ..... G08B 13/14

(52) U.S. Cl. ..... 340/572.2; 340/572.5; 340/10.3

(58) Field of Search ..... 340/551, 572.1, 340/572.2, 572.3, 572.4, 572.5, 572.7, 10.1, 10.3, 10.4; 342/43, 45, 357.08

(56) References Cited

U.S. PATENT DOCUMENTS 3,771,116 A * 11/1973 Farrah ..... 367/8
4,274,090 A * 6/1981 Cooper ..... 340/572.2
5,406,262 A 4/1995 Herman et al. ..... 340/572.2
5,471,196 A 11/1995 Pilested ..... 340/572.7
6,034,604 A * 3/2000 Kaltner ..... 340/572.3

FOREIGN PATENT DOCUMENTS

EP 0 561-062 A1 9/1993
EP 1 008 972 A3 4/2001

* cited by examiner

*Primary Examiner*—Van Trieu
(74) *Attorney, Agent, or Firm*—Sughrue Mion, PLLC

(57) ABSTRACT

A security system for monitoring the presence of one or more objects in a monitored zone. The system includes an antenna and at least one tag having a tuned resonant circuit, the tag being associated with one or more objects to be monitored. A transmitter, coupled to the antenna, is operable to transmit at one of a plurality of frequencies in response to a frequency selection signal. A receiver, coupled to the antenna producing a tag detection signal for stopping the cycling of the transmitter frequencies in response to a signal received at the receiver from the tag thereby causing the transmitter at a single frequency when a tag is detected. Also provided is a device for decreasing the output power of the transmitter when the receiver signal is above a predetermined level.

4 Claims, 2 Drawing Sheets

SECURITY SYSTEM FOR MONITORING THE PASSAGE OF ITEMS THROUGH DEFINED ZONES

This invention relates to a security system for monitoring defined zones and, more particularly, for monitoring areas such as exits in shops or stores.

BACKGROUND OF THE INVENTION

Perimeter surveillance or monitoring systems are used in a variety of applications. These systems generally comprise an antenna in the monitored zone and a receiver/transmitter connected to the antenna. Security tags are attached to individual items to be monitored. The security tags include a coil which tunes the tag to a specific resonant frequency. The antenna is also tuned to the same frequency. The antenna transmits a signal at short intervals. The tag, when in the vicinity of the antenna or the monitored zone, will oscillate in response to this received signal. These oscillations can be received by the antenna and be used to detect the presence of the tag in the monitored zone.

In some cases, the security tag resonant circuit is comprised of a fuse element such that a signal of higher energy than that employed for detection causes the fusible link of the resonant circuit to be destroyed to thereby deactivate the tuned circuit so that detection is no longer possible. In these circumstances, a deactivating device is located at a checkout area in a retail establishment or the like and is operable to produce the high energy fields for deactivating the tuned circuit of the security tag. Thus, allowing the article to be removed from the monitored area without triggering the alarm.

In order to keep the cost of the security tags as low as possible, the resonant circuit normally comprises an etched metal on a flexible substrate, such as plastic or cardboard. Thus, the resonant frequency of the security tags are not very accurate. In order to accommodate this, the transmitter is normally swept between two frequencies. Such systems operate from approximately 7.7 MHz to 8.7 MHz and are known as 8.2 MHz systems. In the swept system, the antennas must transmit continuously and, in the case where there are multiple antennas installed close to each other, each must be synchronized to transmit in a phase. This generally requires that each of the antennas are interconnected, which is problematic, particularly when a large area is to be monitored.

Alternatively, a fixed frequency system as for example, described in U.S. Pat. No. 5,471,196 may be utilized. These systems generally operate in the 2 MHz range and require accurately tuned tags. In the fixed frequency system, the transmitter emits a short burst of energy for approximately a few milliseconds. The system then waits for radiation emitted by the tags before transmitting another burst of energy. Timing of the burst may be synchronized to the mains frequency, which makes it possible to operate a number of systems, all having short bursts at different times. Thus, for a 1.2 mS burst synchronized to the mains frequency, makes it possible to operate up to twelve systems, all having short bursts at different times. Thus, although the frequency system overcomes a problem of synchronizing multiple systems, it still suffers from the disadvantages of requiring accurately tuned tags.

Accordingly, there is a need for a system which mitigates the above disadvantages of present systems.

SUMMARY OF THE INVENTION

This invention thus seeks to provide a security system that may operate with tags that are not accurately tuned, thus, operating like a swept frequency system while offering advantages of a fixed frequency system.

A further object of the invention is to provide a security system with increased detection range while minimizing the possibility of accidental tag deactivation by the system.

In accordance with this invention there is provided a security system for monitoring the presence of one or more objects in a monitored zone, said system comprising an antenna and at least one tuned resonant circuit associated with one or more objects to be monitored;

a transmitter coupled to said antenna operable to transmit at one of a plurality of frequencies in response to a frequency selection signal, said transmitter operating said antenna for cyclic transmission of each of said plurality of frequencies within a repeatable transmission/receive sequence interrupted by pause intervals;

a receiver coupled to said antenna and for producing a detection signal for stopping said cycling of said transmitter frequencies in response to a signal received at said receiver from said resonant circuit thereby causing said transmitter to transmit only at a single frequency when a tag is detected.

In accordance with a further aspect of this invention there is provided a security system for monitoring the presence of one or more objects in a monitored zone, said system comprising an antenna and at least one turned resonant circuit associated with one or more objects to be monitored;

a transmitter coupled to said antenna operable to transmit at one of a plurality of frequencies in response to a frequency selection signal;

a receiver coupled to said antenna and for producing a detection signal and a level detection circuit coupled to an output of said receiver for decreasing the output power of said transmitter when said received signal is above a predetermine level.

BRIEF DESCRIPTION OF THE DRAWINGS

These and other features of the preferred embodiments of the invention will become more apparent in the following detailed description in which reference is made to the appended drawings wherein.

DETAILED DESCRIPTION OF THE PREFERRED EMBODIMENTS

Figure 1:
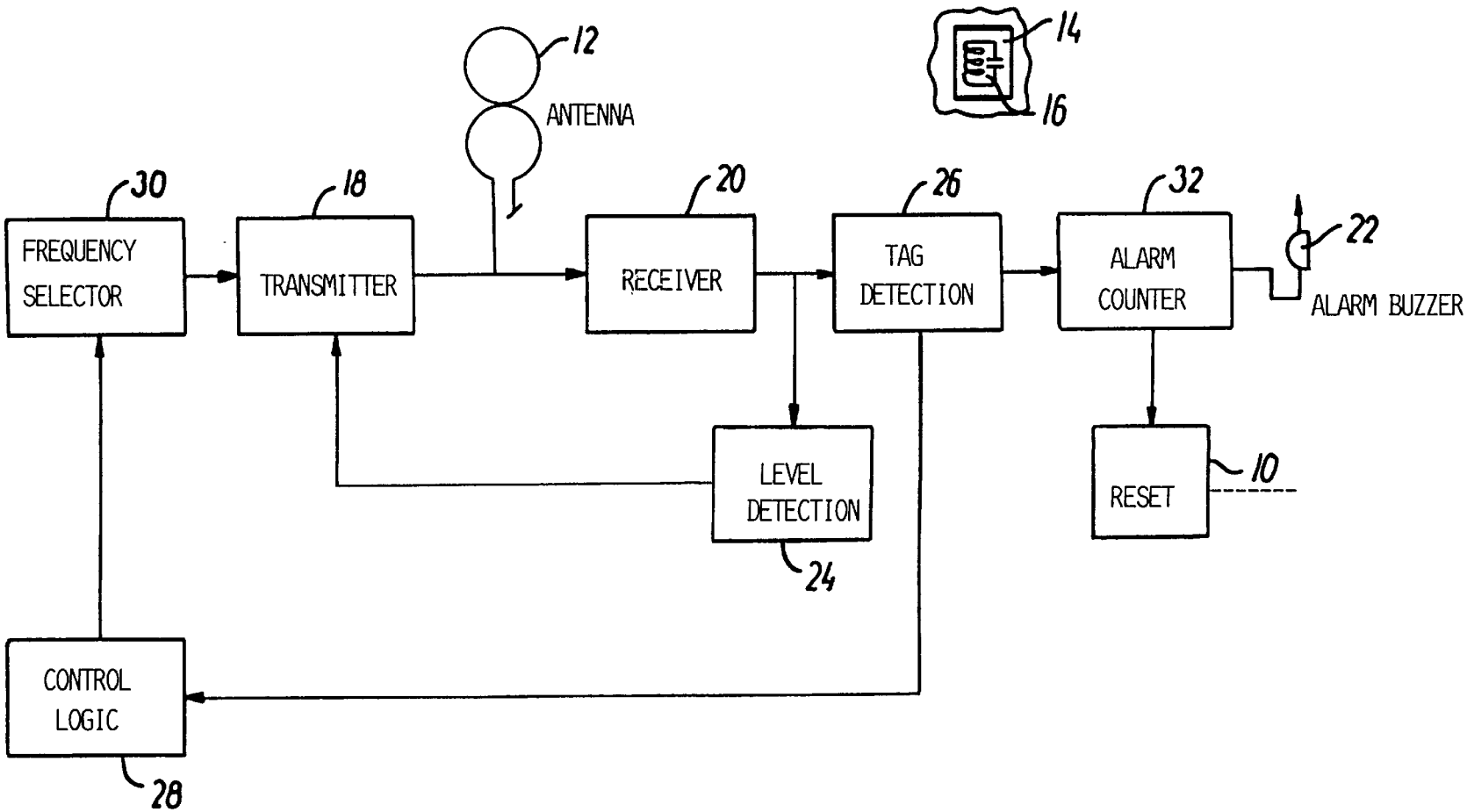
FIG. 1 is a schematic diagram of a system according to the present invention.

Referring to FIG. 1, a security system for monitoring a defined area is shown generally by numeral 10. The system 10 consists of one or more antennas 12 situated at, for example, the exit of a store (not shown) to be protected, and a plurality of tags 14 which may be attached to goods to be secured against, for example, shoplifting. The tags 14 contain a resonant circuit 16 tuned to approximately the same frequency. The antenna 12 is driven by a transmitter 18 at a frequency of the resonant circuit 16 of the tag 14. Thus, when the circuit 16 is excited by the transmitter 18, it starts to oscillate—even after the transmitter has stopped transmitting. This oscillation is received by a receiver circuit 20 coupled to the antenna. The output of the receiver 20 is coupled via a conditioning circuit to an alarm 22. In a preferred embodiment, the antenna is used for both transmission and reception. Thus, the system need only one antenna to function. Other embodiments may use separate antennas.

In order for the system to provide the benefits of a fixed frequency system with improved detection range, the system includes a signal level detection unit 24 coupled to receive an output from the receiver 20 and driving the level of the transmitter 18; the output from the receiver 20 also drives a tag detection circuit 26 which, in turn, drives control logic 28 coupled to a frequency selector 30 for operating the transmitter 18 at a plurality of selected frequencies. The output from the tag detection circuit 26 is also provided to an alarm counter 32 for driving the buzzer 22 after a predetermined number of successive tag signals are detected.

Figure 2:
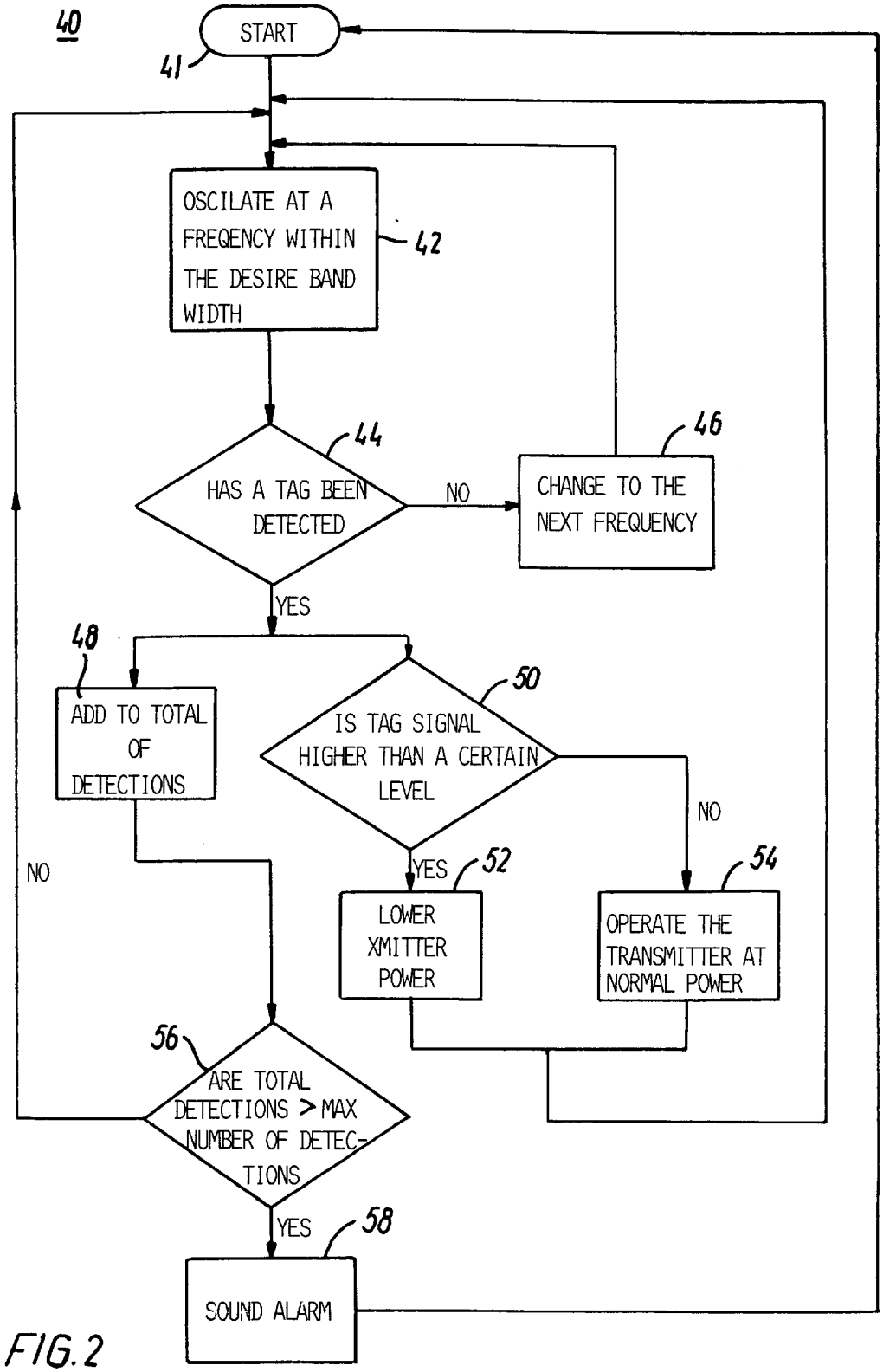
FIG. 2 is a flow diagram for control of the security system shown in FIG. 1.

Referring now to FIG. 2, the operation of the circuit will be described with reference to the flow chart 40 illustrated therein. In the following description, reference will be made to the blocks indicated in FIG. 1. It may also be noted that the blocks shown in FIG. 1 will not be described in detail since the implementation thereof is straightforward and well known in the art. The transmitter 18 is made to sweep over a range of frequencies, typically 7.7 MHz to 8.7 MHz. However, rather than continuously sweep between these frequencies, the transmitter is tuned to fixed frequencies within the range, such as 7.7 MHz, 7.8 MHz, 7.9 MHz, 8.0 MHz, 8.1 MHz, 8.2 MHz, 8.3 MHz, 8.4, 8.5 MHz, 8.6 MHz, 8.7 MHz. Thus, the frequency selector 30 may simply be a switchable series of capacitive elements for tuning a transmitter to each of the frequencies. Thus, at start up, control logic 28 will set the frequency selector to the lowest frequency and begins transmitting. The transmitter 18 thus oscillates at the selected frequency. This is shown as step 42. If a tag is not detected by the receiver, the control logic 28 signals the frequency selector 30 to change the frequency as shown in block 46. If on the other hand, a signal is detected, i.e., the receiver picks up an oscillation from a tag in the vicinity of the antenna, the tag detection circuit 26, which may simply be a comparator, generates an output signal which signals the control logic 28 not to change the transmitter frequency, and increments the alarm counter 33 shown at block 48. At the same time, the level detection circuit 24 determines whether the output from the receiver is above a predetermined level, block 50. If the received tag signal is above the predetermined level, implying that the tag is closer to the antenna, the level detector causes the transmitter 18 to lower its output power by a predetermined amount, block 52. On the other hand, if the received signal is lower that the predetermined level, the transmitter is operated at its currently set power, block 54.

At the same time, the alarm counter 32 determines, as shown in block 56, if a maximum number of detections have been reached. If so, the alarm 22 is triggered shown in block 58. It may be seen from the flow diagram that the system is reset after the alarm is sounded and the program operation begins at the block marked start 41, whereas, if the alarm has not sounded, the system merely cycles back to begin at block 42. It may be noted that the transmitter 18 may simply incorporate circuitry to cycle through a predetermined number of power levels upon receipt of the signal from level detection circuit 24 and the frequency selector may also cycle through the predetermined frequency ranges upon receipt of the signal from the control logic circuit 28 and once the last frequency is encountered, to reset itself by cycling back to the lower start frequency.

In a preferred embodiment, the system will sound the alarm after approximately twelve sequential detections. Furthermore, it may be seen that if the changing of the frequency stops as soon as a tag is detected, and the system continues as a fixed frequency system, the time necessary to detect a tag is much shorter than a swept system and therefore, more systems may operate together as a fixed frequency system synchronized to the mains frequency.

Furthermore, because the circuit adjusts the transmitter voltage to a lower voltage, if the received tag signal is higher than a predetermined threshold, the transmitter will not deactivate the tag. Thus, the system may operate at a high transmitter power, giving a long detection range, without deactivating tags close to the transmitter antenna.

The system of FIG. 1 may cycle through a burst of 4 transmit/receive sequences of approximately 0.5 milliseconds and a pause of approximately 9.5 milliseconds for 50 Hz systems (7.8 milliseconds for 60 Hz systems). In the pause, other antennas can cycle through their transmit/receive sequence without disturbing each other.

The antennas and transmitters are synchronized to the mains, and therefore no special synchronization cables are needed. The system may have a figure eight-shaped antenna loop, this antenna has the best detection of a horizontal tag, while a figure zero antenna loop has a better detection of a vertical tag. Combining these antennas in the system gives a uniform detection range of tags held in all possible orientations.

Although the invention has been described with reference to certain specific embodiments, various modifications thereof will be apparent to those skilled in the art without departing from the spirit and scope of the invention as outlined in the claims appended hereto.

What is claimed is:

1. A security system for monitoring the presence of one or more objects in a monitored zone, said system comprising an antenna and at least one tag having a tuned resonant circuit associated with one or more objects to be monitored;

a transmitter coupled to said antenna operable to transmit at one of a plurality of frequencies in response to a frequency selection signal, said transmitter operating said antenna for cyclic transmission of each of said plurality of frequencies within a repeatable transmission/receive sequence interrupted by pause intervals;

a receiver coupled to said antenna and for producing a tag detection signal for stopping said cycling of said transmitter frequencies in response to a signal received at said receiver from said tag thereby causing said transmitter to transmit at a single frequency when a tag is detected.

2. A system as defined in claim 1, including a level detection circuit coupled to an output of said receiver for decreasing the output power of said transmitter when said received signal is above a predetermined level.

3. A security system for monitoring the presence of one or more objects in a monitored zone, said system comprising an antenna and at least one tag having a tuned resonant circuit associated with one or more objects to be monitored;

a transmitter coupled to said antenna operable to transmit at one of a plurality of frequencies in response to a frequency selection signal;

a receiver coupled to said antenna and for producing a detection signal and a level detection circuit coupled to an output of said receiver for decreasing the output power of said transmitter when said received signal is above a predetermine level.

4. A system as defined in claim 3, wherein said transmitter operates said antenna for cyclic transmission of each of said plurality of frequencies within a repeatable transmission/receive sequence interrupted by pause intervals, and said receiver produces a detection signal for stopping said cycling of said transmitter frequencies in response to a signal received at said receiver from said tag thereby causing said transmitter to transmit at a single frequency when a tag is detected.

* * * * *